US008403652B2

(12) United States Patent
Maejima et al.

(10) Patent No.: US 8,403,652 B2
(45) Date of Patent: Mar. 26, 2013

(54) MOLECULAR PUMP AND FLANGE HAVING SHOCK ABSORBING MEMBER

(75) Inventors: Yasushi Maejima, Yachiyo (JP); Yoshinobu Ohtachi, Yachiyo (JP); Rumiko Wada, Yachiyo (JP); Yoshihiro Enomoto, Yachiyo (JP); Chris Bailey, Yachiyo (JP); Dawn Stephenson, Yachiyo (JP); Kate Wilson, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 826 days.

(21) Appl. No.: 12/225,041

(22) PCT Filed: Mar. 15, 2007

(86) PCT No.: PCT/JP2007/055172

§ 371 (c)(1),
(2), (4) Date: Oct. 27, 2008

(87) PCT Pub. No.: WO2007/105785

PCT Pub. Date: Sep. 20, 2007

(65) Prior Publication Data

US 2009/0081056 A1 Mar. 26, 2009

(30) Foreign Application Priority Data

Mar. 15, 2006 (JP) ..... 2006-71722
Jun. 16, 2006 (JP) ..... 2006-167968

(51) Int. Cl.
*F04D 19/04* (2006.01)

(52) U.S. Cl. ..... 417/423.4; 417/363; 415/90

(58) Field of Classification Search ..... 417/423.4, 417/360; 415/90, 119

See application file for complete search history.

(56) References Cited

U.S. PATENT DOCUMENTS

| | | | | |
|---|---|---|---|---|
| 6,485,254 | B1 * | 11/2002 | Davis | 415/9 |
| 2002/0172589 | A1 * | 11/2002 | Yamashita et al. | 415/90 |
| 2003/0095863 | A1 | 5/2003 | Okudera et al. | 415/90 |
| 2004/0191446 | A1 * | 9/2004 | Kriesel | 428/35.7 |
| 2005/0047905 | A1 | 3/2005 | Kabasawa et al. | 415/90 |
| 2005/0244219 | A1 | 11/2005 | Mathes et al. | 403/335 |

FOREIGN PATENT DOCUMENTS

| | | |
|---|---|---|
| EP | 1312804 | 5/2003 |
| EP | 1314892 | 5/2003 |
| EP | 1413761 | 4/2004 |
| EP | 1943424 | 7/2008 |

(Continued)

OTHER PUBLICATIONS

Machine english translation of JP10274189 to Kubo, published Oct. 13, 1998.*

*Primary Examiner* — Sikha Roy

(57) ABSTRACT

A molecular pump has a cylindrical casing, a stator portion formed in the casing, a shaft disposed in the stator portion, a bearing pivotally supporting the shaft with respect to the stator portion, a rotor that is attached to the shaft and rotates integrally with the shaft, a motor for rotationally driving the shaft, a shock absorbing member, and a flange portion provided at an end portion of the casing. The flange portion has a bolt hole through which extends a bolt for fixing the casing and a fixed member to each other and an insertion hole which is provided adjacent to the bolt hole and in which the shock absorbing member is inserted so that at least one end side of the shock absorbing member extending along an axial direction of the bolt is spaced apart from the bolt.

42 Claims, 14 Drawing Sheets

FOREIGN PATENT DOCUMENTS

| | | |
|---|---|---|
| JP | 10 274189 | 10/1998 |
| JP | 2003 148388 | 5/2003 |
| JP | 2003 284403 | 10/2003 |
| JP | 2004 0162696 | 6/2004 |
| JP | 2005 180233 | 7/2005 |
| JP | 2005 537418 | 12/2005 |
| JP | 2006 037930 | 2/2006 |

* cited by examiner (a)

(b)

(c)

(a)

(b)

(a)

(b)

(a)

(b)

(a)

(b)

(a)

(b)

(a)

(b)

(a)

(b)

(a)

(b)

MOLECULAR PUMP AND FLANGE HAVING SHOCK ABSORBING MEMBER

CROSS-REFERENCE TO RELATED APPLICATIONS

This application is a U.S. national stage application of International Application No. PCT/JP2007/55172, filed Mar. 15, 2007, claiming an earliest priority date of Mar. 15, 2006, and published in a non-English language.

BACKGROUND OF THE INVENTION

1. Technical Field

The present invention relates to a molecular pump and a flange and, more particularly, to a turbo molecular pump used, for example, for the evacuation of a vacuum vessel and a flange thereof.

2. Background Art

A molecular pump (vacuum pump) such as a turbo molecular pump and a thread groove pump has been often used, for example, for the evacuation of semiconductor manufacturing equipment or a vacuum vessel requiring a high vacuum for an electron microscope.

A suction port of the molecular pump is provided with a flange, and the flange can be fixed to an exhaust port of the vacuum vessel with bolts and the like. Between the flange and the exhaust port of the vacuum vessel, an O-ring, a gasket, or the like is provided to maintain the gastightness between the molecular pump and the vacuum vessel.

In the molecular pump, there are provided a rotor portion that is pivotally supported so as to be capable of being rotated at a high speed by a motor section and a stator portion that is fixed to a casing of the molecular pump.

For the molecular pump, the rotor portion and the stator portion accomplish an evacuating action due to the high-speed rotation of the rotor portion. By this evacuating action, gas is sucked through the suction port of molecular pump and is exhausted through an exhaust port.

Usually, the molecular pump exhausts gas in the molecular flow region (a region in which the degree of vacuum is high, and the frequency of collision between molecules is low). In order to demonstrate the evacuation capability in the molecular flow region, the rotor portion must be rotated at a high speed of, for example, about 30,000 revolutions per minute.

Usually, the molecular pump exhausts gas in the molecular flow region (a region in which the degree of vacuum is high, and the frequency of collision between molecules is low). In order to demonstrate the evacuation capability in the molecular flow region, the rotor portion must be rotated at a high speed of, for example, about 30,000 revolutions per minute.

In the case where some trouble occurs during the operation of the molecular pump, and the rotor portion collides with the stator portion or another fixed member in the molecular pump, the angular momentum of the rotor portion is transmitted to the stator portion or the fixed member, by which a large torque that rotates the whole of the molecular pump in the rotation direction of rotor portion is generated in a moment. This torque develops a high stress in the vacuum vessel via the flange.

A technique for easing a shock caused by such a torque has been proposed in Japanese Patent Laid-Open No. 2004-162696.

Japanese Patent Laid-Open No. 2004-162696 has proposed a technique in which a shock absorbing portion for absorbing a shock caused by the rotation torque of rotor is provided on a flange provided at the suction port end of the molecular pump.

Specifically, the flange is provided with a cavity portion adjacent to a bolt hole, and a thin-wall portion is formed between the bolt hole and the cavity portion. In the case where a shock in the rotation direction of a rotor portion is produced in the molecular pump, for example, by the fracture of the rotor portion, a bolt that fixes the flange of the molecular pump to a vacuum device hits the thin-wall portion, whereby the thin-wall portion is subjected to plastic deformation. By this plastic deformation of the thin-wall portion, the shock produced in the molecular pump can be eased.

DISCLOSURE OF INVENTION

Technical Problem

In the above-described molecular pump described in Japanese Patent Laid-Open No. 2004-162696, the shock absorbing portion for absorbing a shock caused by the rotation torque produced, for example, at the time of fracture of the rotor is formed by directly fabricating the flange.

Since the flange and the casing of molecular pump are formed integrally, as the size of casing increases, the work efficiency at the time of fabricating the shock absorbing portion decreases.

Accordingly, the present invention has an object of providing a shock absorbing structure for absorbing a shock more easily.

SUMMARY OF THE INVENTION

In an invention of a first aspect, to achieve the above object, the present invention provides a molecular pump including a cylindrical casing; a stator portion formed in the casing; a shaft disposed in the stator portion; a bearing pivotally supporting the shaft with respect to the stator portion; a rotor which is attached to the shaft and rotates integrally with the shaft; a motor for driving and rotating the shaft; a shock absorbing member; and a flange portion having a bolt hole which is provided in an end portion of the casing and through which a bolt for fixing the casing and a fixed member to each other penetrates and an insertion hole which is provided adjacent to the bolt hole and in which the shock absorbing member is inserted.

In the invention of the first aspect, the bolt hole is preferably provided, for example, in communication with the insertion hole.

In the invention of the first aspect, the insertion hole preferably penetrates in the thickness direction of the flange portion.

In the invention of the first aspect, the fixed member is preferably a vacuum vessel that is evacuated, for example, by the molecular pump.

In an invention of a second aspect, to achieve the above object, the present invention provides a molecular pump includes a cylindrical casing; a stator portion formed in the casing; a shaft disposed in the stator portion; a bearing pivotally supporting the shaft with respect to the stator portion; a rotor which is attached to the shaft and rotates integrally with the shaft; a motor for driving and rotating the shaft; a shock absorbing member; and a flange portion having a bolt penetrating portion which is provided in an end portion of the casing and through which a bolt for fixing the casing and a fixed member to each other penetrates and an insertion portion in which the shock absorbing member is inserted.

In the invention of the second aspect, the insertion portion preferably penetrates in the thickness direction of the flange portion.

In the invention of the second aspect, the fixed member is preferably a vacuum vessel that is evacuated, for example, by the molecular pump.

In an invention of a third aspect, in the molecular pump according to the invention of the first or second aspect, the insertion hole is provided on the opposite side to the rotation direction of the rotor with respect to the bolt.

In an invention of a fourth aspect, in the molecular pump according to the invention of the first, second or third aspect, the insertion hole has a shape extending long in a circumferential direction.

In an invention of a fifth aspect, in the molecular pump according to the invention of the first, second, third or fourth aspect, the shock absorbing member has a thickness smaller than that of the flange portion.

In an invention of a sixth aspect, in the molecular pump according to the invention of the first, second, third or fourth aspect, the shock absorbing member has a thickness larger than that of the flange portion, and a spacer member is provided between the flange portion and the fixed member.

In an invention of a seventh aspect, in the molecular pump according to the invention of any one of the first to sixth aspects, a falling preventive structure for preventing falling of the shock absorbing member is provided.

In an invention of an eighth aspect, in the molecular pump according to the invention of the seventh aspect, the falling preventive structure is formed by a washer through which the bolt penetrates.

In the invention of the eighth aspect, the washer preferably has a diameter larger than the length in the radial direction of the flange portion, for example, in the insertion hole.

In an invention of a ninth aspect, in the molecular pump according to the invention of the seventh aspect, the falling preventive structure is formed by a projecting portion provided on the flange portion.

In the invention of the ninth aspect, the projecting portion is preferably formed so as to extend from the inside surface of the insertion hole toward the inside, for example, in the opening end of the insertion hole.

In an invention of a tenth aspect, in the molecular pump according to the invention of the seventh aspect, the falling preventive structure is formed by the insertion hole at least a part of the inside surface of which is tilted.

In the invention of the tenth aspect, the falling preventive structure is preferably formed by the insertion hole in which, for example, the inside surface is machined into a taper shape.

In the invention of the tenth aspect, the insertion hole is preferably formed so that, for example, the area of an opening end on the surface side opposed to the fixed member is larger than the area of the opening end on the opposite side.

In an invention of an eleventh aspect, in the molecular pump according to the invention of any one of the first to tenth aspects, the shock absorbing member has a thin-wall portion.

In the invention of the eleventh aspect, the thin-wall portion is preferably formed, for example, by forming a plurality of through holes in the shock absorbing member.

In an invention of a twelfth aspect, in the molecular pump according to the invention of any one of the first to eleventh aspects, the shock absorbing member is formed of a gel material.

In an invention of a thirteenth aspect, in the molecular pump according to the invention of any one of the first to twelfth aspects, the molecular pump further includes an intermediate flange provided between the flange portion and the fixed member, and the flange portion be fixed to the fixed member via the intermediate flange.

In the invention of the thirteenth aspect, it is preferable that the fixed member be fixed directly to the intermediate flange, for example, by bolts, and the intermediate flange is fixed to the flange portion by bolts.

In an invention of a fourteenth aspect, in the molecular pump according to the invention of the second aspect, the bolt penetrating portion and the insertion portion are arranged in an identical void formed in the flange portion.

In an invention of a fifteenth aspect, in the molecular pump according to the invention of the fourteenth aspect, the void formed in the flange portion has a shape extending to the opposite side to the rotation direction of the rotor with respect to the bolt penetrating portion.

In an invention of a sixteenth aspect, to achieve the above object, the present invention provides a flange for connecting the end portion of a casing for a molecular pump to a fixed member, including a shock absorbing member; a bolt hole through which a bolt for fixing the flange to the fixed member penetrates; and an insertion hole which is provided adjacent to the bolt hole and in which the shock absorbing member is inserted.

In an invention of a seventeenth aspect, to achieve the above object, the present invention provides a flange for connecting the end portion of a casing for a molecular pump to a fixed member, including a shock absorbing member; a bolt penetrating portion through which a bolt for fixing the flange to the fixed member penetrates; and an insertion portion in which the shock absorbing member is inserted.

In an invention of an eighteenth aspect, in the flange according to the invention of the seventeenth aspect, the bolt penetrating portion and the insertion portion are arranged in an identical void formed in the flange.

According to the present invention, by providing the shock absorbing members in the insertion holes in the flange portion, the shock absorbing structure can be formed more easily.

EXPLANATION OF REFERENCE

Figure 1:
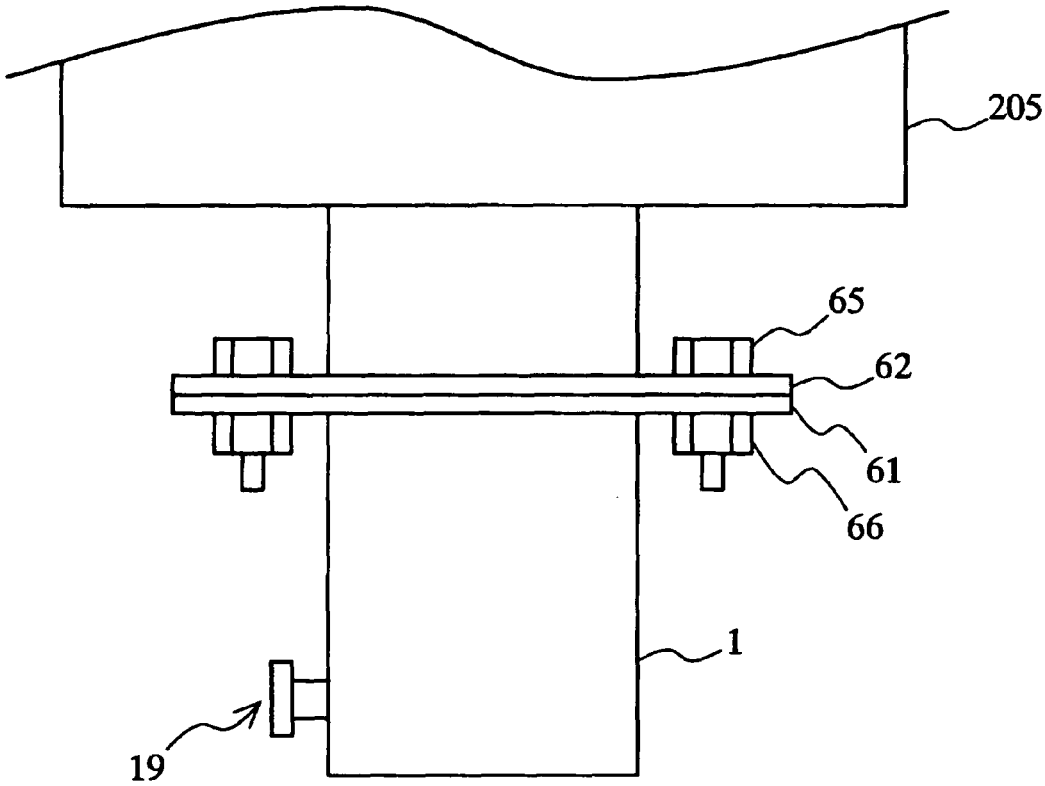
FIG. 1 is a view showing one example of a mode in which a molecular pump in accordance with an embodiment of the present invention is attached to a vacuum vessel.

1 . . . molecular pump
5 . . . thread groove spacer
6 . . . suction port
7 . . . spiral groove
8 . . . magnetic bearing portion
9 . . . displacement sensor
10 . . . motor section
11 . . . shaft
12 . . . magnetic bearing portion
13 . . . displacement sensor
14 . . . bolt hole
15 . . . groove
16 . . . casing
17 . . . displacement sensor
18 . . . stator column
19 . . . exhaust port
20 . . . magnetic bearing portion
21 . . . rotor blade
22 . . . stator blade
23 . . . spacer
24 . . . rotor portion
25 . . . bolt
27 . . . base
29 . . . cylindrical member
31 . . . bolt hole
32 . . . bolt hole
33 . . . insertion hole
34 . . . insertion hole
35 . . . bolt hole
40 . . . insertion hole
49 . . . collar
50 . . . shock absorbing member
51 . . . shock absorbing member
61 . . . flange
62 . . . flange
63 . . . intermediate flange
65 . . . bolt
66 . . . nut
67 . . . bolt
68 . . . bolt
69 . . . nut
71 . . . cavity portion
72 . . . cavity portion
73 . . . cavity portion
81 . . . thin-wall portion
82 . . . thin-wall portion
83 . . . thin-wall portion
91 . . . washer
92 . . . projecting portion
95 . . . spacer
99 . . . step portion
114 . . . bolt penetrating portion
140 . . . insertion portion
150 . . . shock absorbing member
161 . . . flange
165 . . . bolt
205 . . . vacuum vessel

DETAILED DESCRIPTION OF THE PREFERRED EMBODIMENT

A preferred embodiment of the present invention will now be described in detail with reference to FIGS. 1 to 13.

(1) Outline of Embodiment

In this embodiment, a shock absorbing structure for consuming shock energy is provided on a flange 61 of a molecular pump 1.

Figure 3:
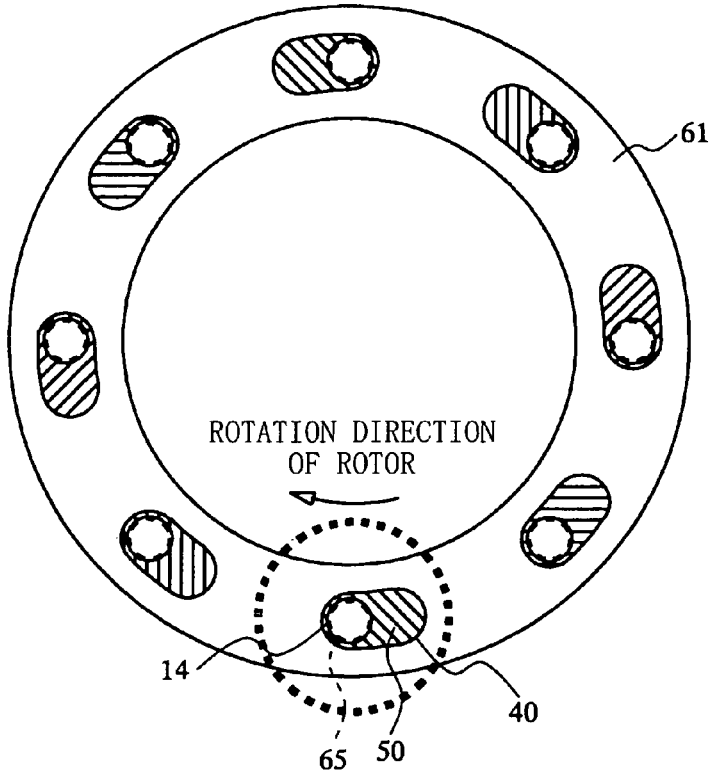
FIG. 3A is a view of a flange taken in the direction of the arrow A of FIG. 2.
FIG. 3B is an enlarged view of a shock absorbing structure provided in the flange, indicated by the broken line circle in FIG. 3A.
FIG. 3C is a sectional view taken along the line A-A' of FIG. 3B.
Figure 3:
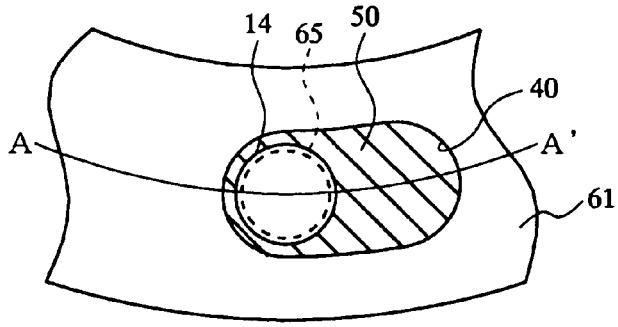
Figure 3:
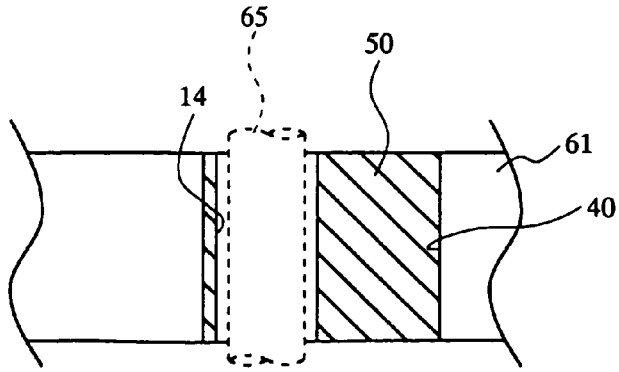

For example, as shown in FIG. 3, insertion holes 40 are provided in the flange 61, and a shock absorbing member 50 formed by a separate member is insertedly fixed in each of the insertion holes 40.

In the shock absorbing member 50, there is provided a bolt hole 14 for inserting a bolt 65 for fixing the flange 61 to a vacuum vessel 205.

Figure 6:
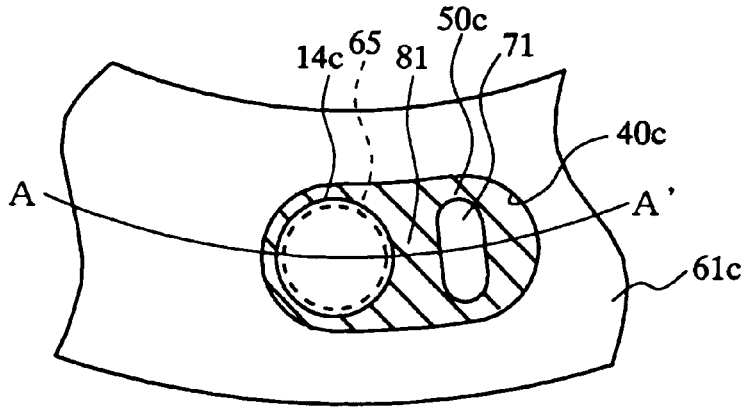
FIG. 6A is a view for explaining a flange in accordance with still another example of shock absorbing structure.
FIG. 6B is a sectional view taken along the line A-A' of FIG. 6A.
Figure 6:
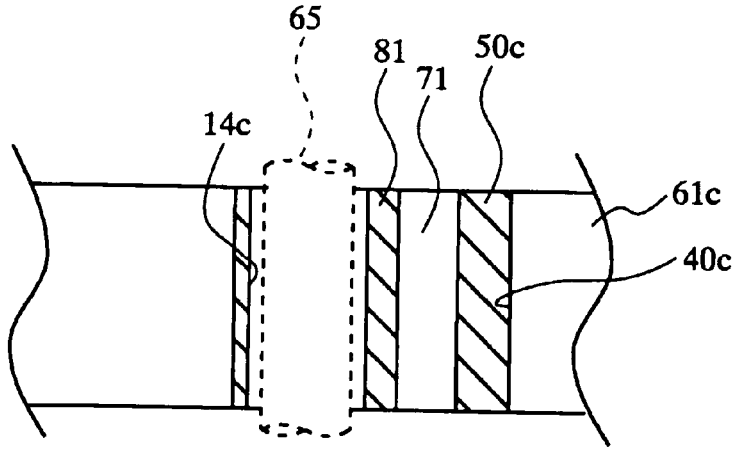
Figure 7:
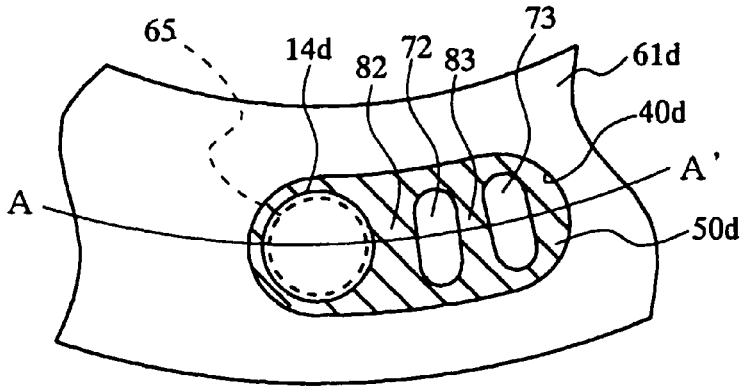
FIG. 7A is a view for explaining a flange in accordance with still another example of shock absorbing structure.
FIG. 7B is a sectional view taken along the line A-A' of FIG. 7A.
Figure 7:
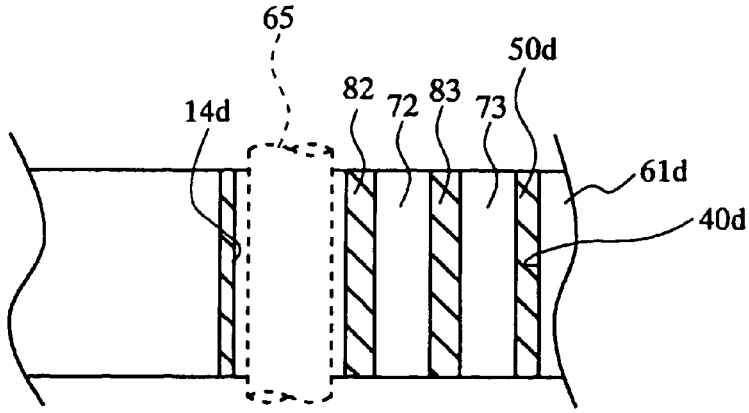

The shock absorbing member 50 is formed by a member capable of being plastically deformed when the bolt 65 collides. Also, as shown in FIGS. 6 and 7, the shock absorbing member 50 is formed with a thin-wall portion by forming a cavity portion.

In the case where a shock in the rotation direction of a rotor portion is produced in the molecular pump by fracture of the rotor portion, the flange 61 slides in the rotation direction of the rotor portion together with the molecular pump. Then, the bolt 65 that fixes the flange 61 to the flange of the vacuum vessel 205 hits the shock absorbing member 50, whereby the shock absorbing member 50 is subjected to plastic deformation. By this plastic deformation of the shock absorbing member 50, energy for rotating the molecular pump is consumed, so that the shock produced in the molecular pump can be absorbed.

Also, in the molecular pump 1 in accordance with this embodiment, the shock absorbing member 50 is formed by an independent and small part (piece).

Therefore, the fabrication of the shock absorbing member 50 can be carried out easily.

(2) Details of Embodiment

FIG. 1 is a view showing one example of a mode in which the molecular pump 1 in accordance with this embodiment is attached to the vacuum vessel 205.

The molecular pump 1 is a vacuum pump that performs an evacuating function due to the evacuating action of the rotor portion rotating at a high speed and a fixed stator portion, including a turbo molecular pump, a thread groove pump, and a pump that has constructions of both types of these pumps.

The flange 61 is formed on the suction port side of the molecular pump 1, and an exhaust port 19 is provided on the exhaust side thereof.

The vacuum vessel 205 forms a vacuum device for semiconductor manufacturing equipment or a lens barrel of electron microscope, and the exhaust port thereof is formed with a flange 62.

The vacuum vessel 205 functions as a member fixed to the molecular pump 1.

In the flanges 61 and 62, a plurality of bolt holes are formed at the same positions on a concentric circle. By inserting the bolts 65 through these bolt holes and by threadedly tightening nuts 66 on the bolts 65, the molecular pump 1 is attached and fixed to the lower part of the vacuum vessel 205. The gas in the vacuum vessel 205 is sucked through the suction port of the molecular pump 1 and is exhausted through the exhaust port 19. Thereby, a reaction gas for manufacturing semiconductors or other gases can be exhausted from the vacuum vessel 205.

In the example shown in FIG. 1, the configuration is such that the molecular pump 1 is attached to the lower part of the vacuum vessel 205, and the molecular pump 1 depends from the vacuum vessel 205. However, the installation position of the molecular pump 1 is not limited to this configuration. The molecular pump 1 may be attached to the side of the vacuum vessel 205 in a horizontal posture, or may be attached to above the vacuum vessel 205 in the state in which the molecular pump 1 is positioned with the suction port being on the lower side.

Further, a valve for regulating the flow rate of exhaust gas is sometimes provided between the exhaust port of the vacuum vessel 205 and the suction port of the molecular pump 1.

Also, the exhaust port 19 is generally connected to a roughing vacuum pump such as a rotary pump.

Figure 2:
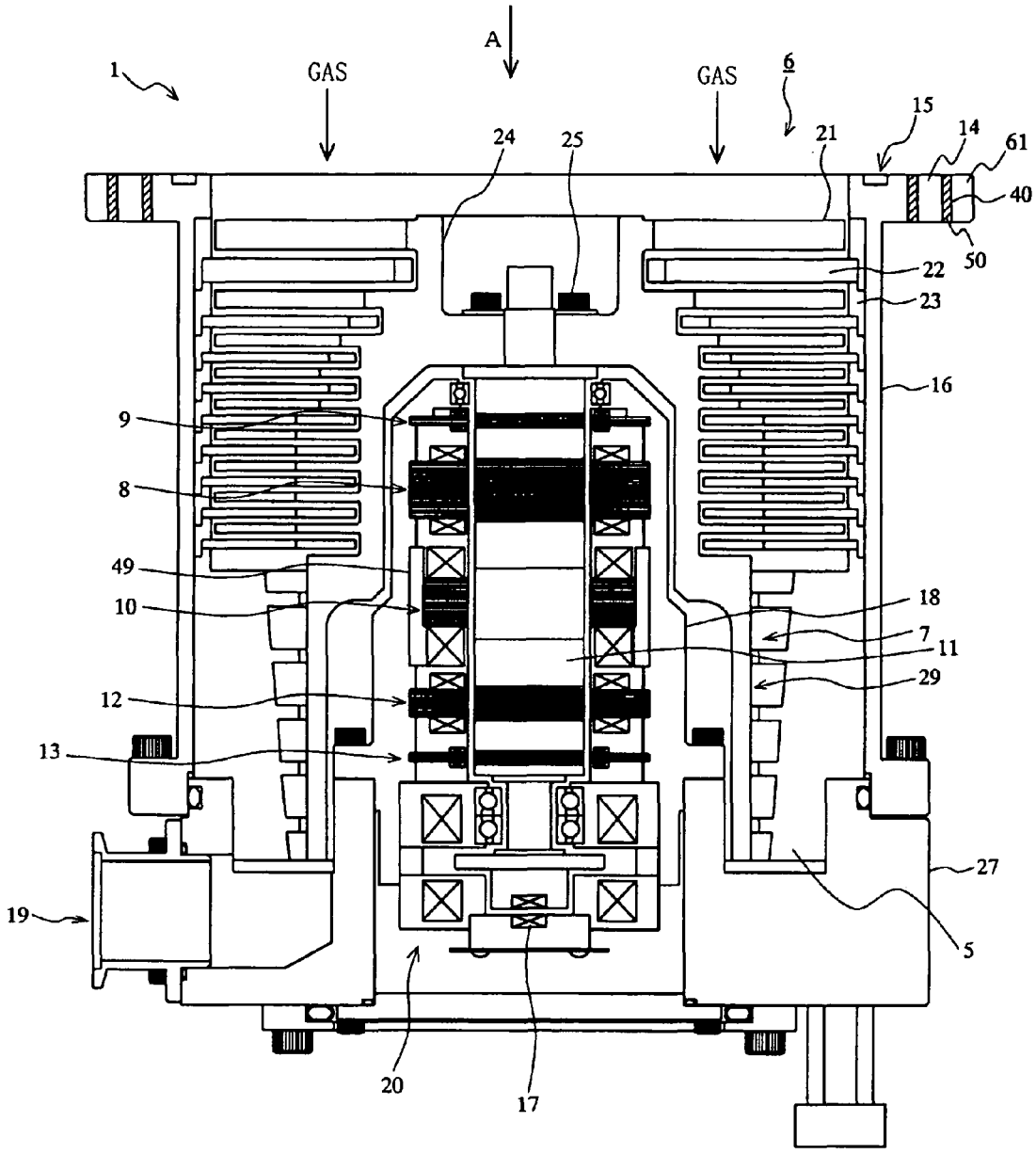
FIG. 2 is a sectional view in the axial direction of a molecular pump in accordance with an embodiment of the present invention.

FIG. 2 is a sectional view in the axial direction of the molecular pump 1 of this embodiment.

In this embodiment, what is called a composite blade type molecular pump provided with a turbo molecular pump section and a thread groove pump section is explained as one example of molecular pump.

A casing 16 forming the external body of the molecular pump 1 has a cylindrical shape, and forms the housing of the molecular pump 1 together with a disc-shaped base 27 provided at the bottom of the casing 16. In the casing 16, a structure for the molecular pump 1 to perform the evacuating function is housed.

The structure that performs the evacuating function is broadly divided into a pivotally supported rotor portion 24 and a stator portion fixed to the casing 16.

Also, when being viewed from the viewpoint of pump type, the suction port 6 side is formed by the turbo molecular pump section, and the exhaust port 19 side is formed by the thread groove pump section.

The rotor portion 24 includes rotor blades 21 provided on the suction port 6 side (turbo molecular pump section), a cylindrical member 29 provided on the exhaust port 19 side (thread groove pump section), and a shaft 11. The rotor blade 21 is formed by a blade that extends radially from the shaft 11 so as to be tilted through a predetermined angle from the plane perpendicular to the axis line of the shaft 11. In the turbo molecular pump section, the rotor blade 21 is formed in a plurality of tiers in the axis line direction.

The cylindrical member 29 is a member whose outer peripheral surface has a cylindrical shape, and forms the rotor portion 24 of the thread groove pump section.

This shaft 11 is a columnar member forming the axis of the rotor portion 24. In the upper end portion thereof, a member consisting of the rotor blades 21 and the cylindrical member 29 is threadedly mounted by bolts 25.

At an intermediate position in the axis line direction of the shaft 11, a permanent magnet is fixed to the outer peripheral surface, and forms a rotor of a motor section 10. The magnetic pole formed at the outer periphery of the shaft 11 by the permanent magnet provides an N pole over a semicircle of the outer peripheral surface and provides an S pole over the remaining semicircle.

Further, on the suction port 6 side and the exhaust port 19 side of the shaft 11 with respect to the motor section 10, there are formed portions on the rotor portion 24 side of magnetic bearing portions 8 and 12 for pivotally supporting the shaft 11 in the radial direction, respectively. At the lower end of the shaft 11, there is formed a portion on the rotor portion 24 side of a magnetic bearing portion 20 for pivotally supporting the shaft 11 in the axis line direction (thrust direction).

Also, near the magnetic bearing portions 8 and 12, portions on the rotor side of displacement sensors 9 and 13 are formed, respectively, so that the displacement in the radial direction of the shaft 11 can be detected. Further, at the lower end of the shaft 11, a portion on the rotor side of a displacement sensor 17 is formed so that the displacement in the axis line direction of the shaft 11 can be detected.

Each of the portions on the rotor side of magnetic bearing portions 8 and 12 and the displacement sensors 9 and 13 is formed by a laminated steel sheet formed by laminating steel sheets in the rotation axis line direction of the rotor portion 24. This is because an eddy current is prevented from developing in the shaft 11 by a magnetic field generated by coils forming portions on the stator side of the magnetic bearing portions 8 and 12 and the displacement sensors 9 and 13.

The above-described rotor portion 24 is formed by using a metal such as stainless steel and aluminum alloy.

On the inner periphery side of the casing 16, the stator portion is formed. The stator portion includes stator blades 22 provided on the suction port 6 side (turbo molecular pump section) and a thread groove spacer 5 provided on the exhaust port 19 side (thread groove pump section).

The stator blade 22 is formed by a blade that extends from the inner peripheral surface of the casing 16 toward the shaft 11 so as to be tilted through a predetermined angle from the plane perpendicular to the axis line of the shaft 11. In the turbo molecular pump section, the stator blades 22 are formed in a plurality of tiers in the axis line direction alternately with the rotor blades 21. The stator blades 22 in the tiers are separated from each other by a cylindrically-shaped spacers 23.

The thread groove spacer 5 is a columnar member formed with a spiral groove 7 in the inner peripheral surface thereof. The inner peripheral surface of the thread groove spacer 5 faces to the outer peripheral surface of the cylindrical member 29 with a predetermined clearance (gap) being provided therebetween. The direction of the spiral groove 7 formed in the thread groove spacer 5 is a direction toward the exhaust port 19 in the case where gas is transported in the rotation direction of the rotor portion 24 in the spiral groove 7. The depth of the spiral groove 7 is shallower toward the exhaust port 19, so that the gas transported in the spiral groove 7 is compressed as the gas approaches the exhaust port 19.

The stator portion is formed by a metal such as stainless steel and aluminum alloy.

The base 27 is a member having a disc shape. In the center in the radial direction of the base 27, a stator column 18 having a cylindrical shape is mounted concentrically with the rotation axis line of rotor so as to be directed toward the suction port 6.

The stator column 18 supports the portions on the stator side of the motor section 10, the magnetic bearing portions 8 and 12, and the displacement sensors 9 and 13.

In the motor section 10, stator coils having a predetermined number of poles are disposed at equal intervals on the inner periphery side of the stator coil so that a rotating magnetic field can be generated around the magnetic pole formed on the shaft 11. Also, at the outer periphery of the stator coil, a collar 49, which is a cylindrical member formed of a metal such as stainless steel, is disposed to protect the motor section 10.

The magnetic bearing portion 8, 12 is formed by coils disposed every 90 degrees around the rotation axis line. The magnetic bearing portion 8, 12 magnetically levitates the shaft 11 in the radial direction due to the attraction of the shaft 11 by means of a magnetic field generated by these coils.

At the bottom of the stator column 18, the magnetic bearing portion 20 is formed. The magnetic bearing portion 20 is made up of a disc projecting from the shaft 11 and coils disposed above and below this disc. The magnetic field generated by these coils attracts the disc, by which the shaft 11 is magnetically levitated in the axis line direction.

This suction port 6 of the casing 16 is formed with the flange 61 projecting to the outer periphery side of the casing 16.

The flange 61 is provided with the insertion holes 40 for inserting the shock absorbing members 50, described later. In the shock absorbing member 50 inserted in the insertion hole 40, namely, in the region of the insertion hole 40, the bolt hole 14 for inserting the bolt 65 is formed.

Also, the flange 61 is formed with a groove 15 for mounting an O-ring for keeping the gastightness between the flange 61 and the flange 62 on the vacuum vessel 205 side.

When a shock in the rotation direction of the rotor portion 24 is produced in the molecular pump 1, the shock absorbing member 50 functions as a mechanism for absorbing the shock (shock absorbing structure). This mechanism is explained later in detail.

The molecular pump 1 configured as described above operates as described below to exhaust gas from the vacuum vessel 205.

First, the magnetic bearing portions 8, 12 and 20 magnetically levitate the shaft 11, by which the rotor portion 24 is pivotally supported in the space in a noncontact manner.

Next, the motor portion 10 is operated to rotate the rotor in the predetermined direction. The rotational speed is, for example, about 30,000 revolutions per minute. In this embodiment, the rotation direction of the rotor portion 24 is the clockwise direction as viewed from the direction indicated by the arrow A in FIG. 2. The molecular pump 1 can also be configured so as to rotate in the counterclockwise direction.

When the rotor portion 24 rotates, gas is sucked through the suction port 6 by the operation of the rotor blades 21 and the stator blades 22, and the gas is compressed as it goes to the lower tier.

The gas having been compressed by the turbo molecular pump portion is further compressed by the thread groove pump portion, and is exhausted through the exhaust port 19.

FIG. 3A is a view of the flange 61 taken in the direction of the arrow A of FIG. 2. To simplify the figure, the groove 15 for the O-ring and the internal construction of the molecular pump 1 are not shown.

Also, FIG. 3B is an enlarged view of a shock absorbing structure provided in the flange 61, indicated by the broken line circle in FIG. 3A.

FIG. 3C is a sectional view taken along the line A-A' of FIG. 3B.

As shown in the figures, the flange 61 is formed with the insertion holes 40 arranged at predetermined intervals on a concentric circle.

In the insertion hole 40, the shock absorbing member 50 formed by a separate member is insertedly fixed.

The shock absorbing member 50 is formed with the bolt hole 14 penetrating in the thickness direction.

The insertion hole 40 is formed into an elongated shape extending in the rotation direction of the rotor portion 24 from the bolt hole 14.

The bolt 65 is configured so as to be inserted in the bolt hole 14 provided in the shock absorbing member 50.

Also, the shock absorbing member 50 is a member for absorbing a shock caused by a rotation torque of the rotor by means of plastic deformation of the shock absorbing member 50 itself, and is formed, for example, of a material having a lower strength than the member forming the flange 61. Specifically, the shock absorbing member 50 is formed, for example, a gel material, such as a gel-form material, using silicone as a main raw material.

The bolt hole 14 need not be filled with the shock absorbing member 50.

Next, the shock absorbing function of the flange 61 configured as described above is explained.

In the molecular pump 1, when the rotor portion 24 rotates at a high speed, if the rotor portion 24 collides with the stator portion etc. due to the fracture of the rotor portion 24, a shock is produced by a torque that tends to rotate the whole of the molecular pump 1 in the rotation direction of the rotor portion 24.

Then, due to this shock, the flange 61 slides and tends to rotate in the rotation direction of the rotor portion 24 with respect to the flange 62 of the vacuum vessel 205.

On the other hand, since the position of the bolt 65 is fixed by the flange 62, if the flange 61 rotates in the rotation direction of the rotor portion 24, the bolt 65 tends to move relatively in the direction to the other end in the bolt hole 14.

Since the bolt hole 14 is provided in the elongated shock absorbing member 50 extending in the rotation direction of the rotor portion 24, the side wall of inner periphery of the shock absorbing member 50 hits the bolt 65, so that the shock absorbing member 50 is pushed from the tangential direction of the direction reverse to the rotation direction of the rotor portion 24 to the direction toward the outside in the radial direction and is subjected to plastic deformation.

In the process in which the shock absorbing member 50 is plastically deformed, the energy for rotating the molecular pump 1 is consumed, and thereby the shock is eased.

As described above, in this embodiment, the flange 61 is provided with the shock absorbing mechanism (shock absorbing structure) formed so that plastic deformation takes place due to the torque that tends to rotate the molecular pump 1. Thereby, even if the rotor portion 24 fractures, or deposits sticking to the rotor portion 24, the stator portion, and the like collide in the molecular pump 1 when reaction gas is exhausted in the semiconductor manufacturing equipment, or the like trouble occurs, the safety can be enhanced.

Also, according to this embodiment, the shock absorbing mechanism (shock absorbing structure) can be formed easily by inserting the shock absorbing member 50 formed by a separate member in the insertion hole 40.

The shock absorbing member 50 can be formed easily, for example, by molding or pressing because it has a small size. Thereby, the manufacturing cost can be reduced.

As the shock absorbing member 50, an elastic member such as rubber may be filled in the insertion hole 40.

FIG. 4A is a view for explaining a flange 61*a* in accordance with another example of shock absorbing structure. FIG. 4B is a sectional view taken along the line A-A' of FIG. 4A.

The flange 61*a* is configured so that bolt holes 14*a* are provided in the flange 61*a*, and insertion holes 40*a* are provided in the outside parts of the bolt holes 14*a*.

Specifically, in the flange 61*a*, the plurality of bolt holes 14*a* are formed at predetermined intervals on a concentric circle.

The substantially semicircular insertion hole 40*a* is formed in the direction reverse to the rotation direction of the rotor portion 24 with respect to the bolt hole 14*a*, and a shock absorbing member 50*a* formed by a separate member is inserted in the insertion hole 40*a*.

The bolt hole 14*a* and the insertion hole 40*a* are partially connected to each other, and a series of through holes formed by these holes are formed in the flange 61*a*.

Also, the surface of the shock absorbing member 50*a*, which faces to the bolt 65, is formed so as to be flat.

In the case were the molecular pump 1 is rotated by a great torque in the rotation direction of the rotor portion 24 generated in the molecular pump 1, for example, by the fracture of the rotor portion 24, the shock absorbing member 50*a* hits the bolt 65 and is subjected to plastic deformation. Thereby, the rotation energy of the molecular pump 1 is absorbed, and thus a shock produced in the molecular pump 1 is eased.

In this example, a step portion 99 is provided on the boundary surface between the bolt hole 14*a* and the insertion hole 40*a*. However, a shape in which this step portion 99 is not provided can also be adopted.

FIG. 5A is a view for explaining a flange 61*b* in accordance with still another example of shock absorbing structure. FIG. 5B is a sectional view taken along the line A-A' of FIG. 5A.

The flange 61*b* is configured so that insertion holes 40*b* are provided in the flange 61*b*, and bolt holes 14*b* are provided in the centers of shock absorbing members 50*b* inserted in the insertion holes 40*b*.

Specifically, in the flange 61*b*, the plurality of insertion holes 40*b* extending long in the circumferential direction are formed at predetermined intervals on a concentric circle.

The bolt hole 14*b* is formed in the center (the central portion) in the lengthwise direction of the shock absorbing member 50*b* that is formed by a separate member and is inserted in the insertion hole 40*b*.

In the case where some trouble occurs during the operation of the molecular pump 1, and thereby, for example, the rotor portion 24 is fractured, depending on the collision mode between the rotor portion 24 and the stator portion, a great force sometimes acts in the direction reverse to the rotation direction of the rotor portion 24.

In this case, in the molecular pump 1 using the flange 61*b* configured as described above, even in the case where a great force (torque) acts in the direction reverse to the rotation direction, the shock absorbing member 50*b* hits the bolt 65 and is subjected to plastic deformation. Thereby, the rotation energy of the molecular pump 1 is absorbed, and thus a shock produced in the molecular pump 1 is eased.

In this embodiment, the configuration is such that the insertion hole 40*b* having a shape extending long in the circumferential direction (a shape along the circumference) is formed in the flange 61*b*. However, the shape of the insertion hole 40*b* is not limited to this shape, and may be a rectangular shape extending linearly.

The bolt hole 14*b* need not be filled with the shock absorbing member 50*b*.

FIG. 6A is a view for explaining a flange 61*c* in accordance with still another example of shock absorbing structure. FIG. 6B is a sectional view taken along the line A-A' of FIG. 6A.

The flange 61*c* is configured so that a cavity portion 71 is provided in a shock absorbing member 50*c* inserted in an insertion hole 40*c*, and thereby a thin-wall portion 81 is formed between a bolt hole 14*c* and the cavity portion 71.

Specifically, in the flange 61*c*, the insertion holes 40*c* extending long in the circumferential direction are provided at predetermined intervals on a concentric circle, and in the insertion hole 40*c*, the shock absorbing member 50*c* formed by a separate member is insertedly fixed.

In the shock absorbing member 50*c*, the bolt hole 14*c* penetrating in the thickness direction is formed in the end region thereof.

Further, in the shock absorbing member 50*c*, the cavity portion 71 consisting of an elongated through hole is formed in the direction reverse to the rotation direction of the rotor portion 24 with respect to the bolt hole 14*c* with a predetermined distance being provided therebetween. Thereby, in the shock absorbing member 50*c*, the thin-wall portion 81 is formed between the bolt hole 14*c* and the cavity portion 71.

If, in the molecular pump 1 using the flange 61*c* configured as described above, a great torque is generated in the rotation direction of the rotor portion 24, and thereby the molecular pump 1 is rotated, the thin-wall portion 81 is pressed in the direction reverse to the rotation direction of the rotor portion 24 by the bolt 65 inserted through the bolt hole 14*c* and is subjected to plastic deformation. Thereby, a shock is absorbed.

The bolt hole 14*c* need not be filled with the shock absorbing member 50*c*.

FIG. 7A is a view for explaining a flange 61*d* in accordance with still another example of shock absorbing structure. FIG. 7B is a sectional view taken along the line A-A' of FIG. 7A.

The flange 61*d* is configured so that cavity portions 72 and 73 are provided in a shock absorbing member 50*d* inserted in an insertion hole 40*d*, and thin-wall portions 82 and 83 are formed between the bolt hole 14*d* and the cavity portion 72 and between the cavity portion 72 and the cavity portion 73, respectively.

Specifically, in the flange 61*d*, the insertion holes 40*d* extending long in the circumferential direction are provided at predetermined intervals on a concentric circle, and in the insertion hole 40*d*, the shock absorbing member 50*d* formed by a separate member is insertedly fixed.

In the shock absorbing member 50*d*, the bolt hole 14*d* penetrating in the thickness direction is formed in the end region thereof.

Further, in the shock absorbing member 50*d*, the cavity portions 72 and 73 each consisting of an elongated through hole are formed in the direction reverse to the rotation direction of the rotor portion 24 with respect to the bolt hole 14*d* with a predetermined distance being provided therebetween. Thereby, in the shock absorbing member 50*d*, the thin-wall portion 82 is formed between the bolt hole 14*d* and the cavity portion 72, and the thin-wall portion 83 is formed between the cavity portion 72 and the cavity portion 73.

If, in the molecular pump 1 using the flange 61*d* configured as described above, a great torque is generated in the rotation direction of the rotor portion 24, and thereby the molecular pump 1 is rotated, the thin-wall portions 82 and 83 are pressed in the direction reverse to the rotation direction of the rotor portion 24 by the bolt 65 inserted through the bolt hole 14*d* and are subjected to plastic deformation. Thereby, a shock is absorbed.

The bolt hole 14*d* need not be filled with the shock absorbing member 50*d*.

The material of the above-described shock absorbing member 50*c*, 50*d* having the thin wall portion may be any material in which the cavity portion can be formed. The shock absorbing member 50*c*, 50*d* can be formed by fabricating a metallic member formed, for example, of aluminum, stainless steel, or copper.

Also, the thickness of the thin-wall portion 81 to 83 formed in the shock absorbing member 50*c*, 50*d* can be set arbitrarily by changing the arrangement position of cavity portion.

In the molecular pump 1 in accordance with the above-described embodiment, the thickness of the thin-wall portion 81 to 83 is set at about 0.5 millimeter to several millimeters depending on the material, thickness, etc. of the shock absorbing member 50*c*, 50*d*.

Also, the number of thin-wall portions provided in the shock absorbing member 50 can be set arbitrarily by changing the number of cavity portions formed. Two or more thin-wall portions may be provided.

Next, a falling preventive structure for preventing the shock absorbing member 50 (50*a* to 50*d*) inserted in the aforementioned insertion hole 40 (40*a* to 40*d*) from falling is explained.

FIG. 8A is a view showing the falling preventive structure in the shock absorbing structure of the molecular pump 1 in accordance with this embodiment. FIG. 8B is a sectional view taken along the line A-A' of FIG. 8A.

Figure 5:
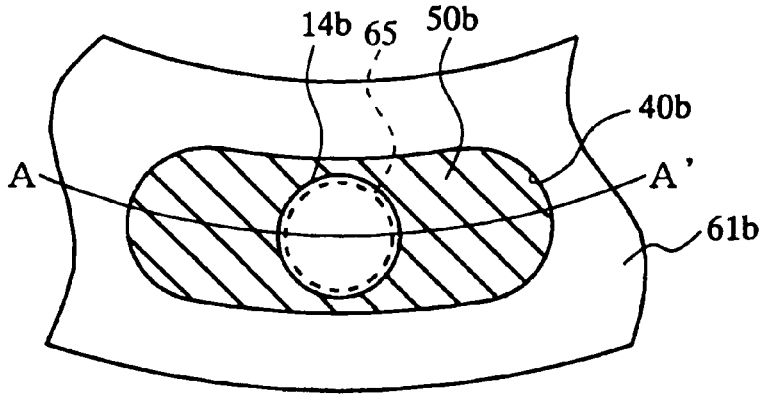
FIG. 5A is a view for explaining a flange in accordance with still another example of shock absorbing structure.
FIG. 5B is a sectional view taken along the line A-A' of FIG. 5A.
Figure 5:
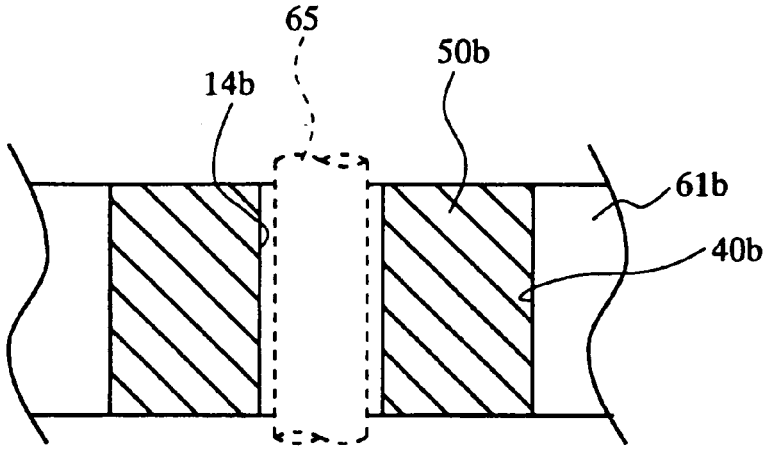

Herein, the falling preventive structure for preventing the shock absorbing member 50*b* provided in the flange 61*b* shown in FIG. 5 from falling is explained. However, the falling preventive structure is not limited to falling prevention of the shock absorbing member 50*b*, and can be applied to the above-described shock absorbing member 50 (50*a* to 50*d*).

Figure 8:
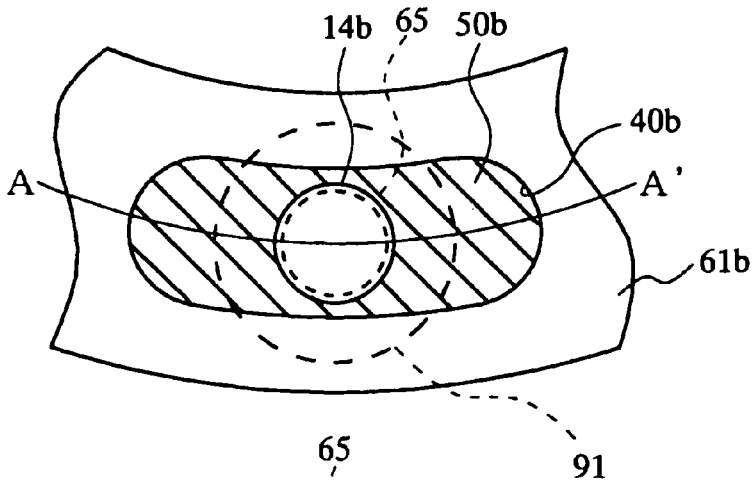
FIG. 8A is a view showing a falling preventive structure in a shock absorbing structure of a molecular pump in accordance with an embodiment of the present invention.
FIG. 8B is a sectional view taken along the line A-A' of FIG. 8A.
Figure 8:
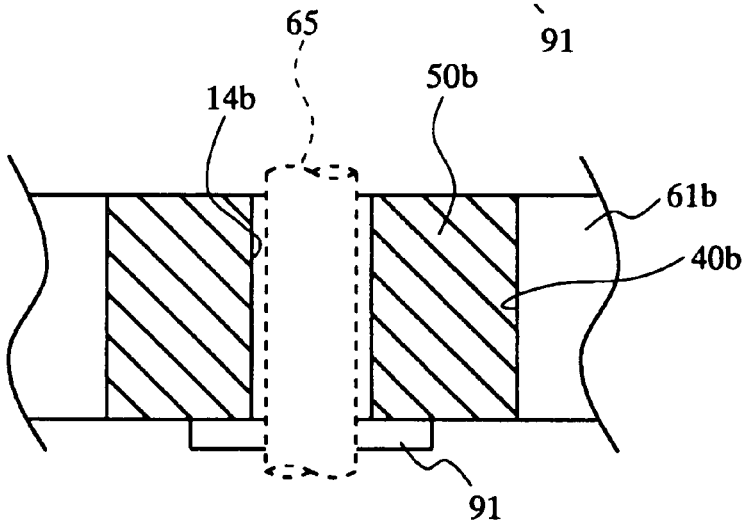
Figure 9:
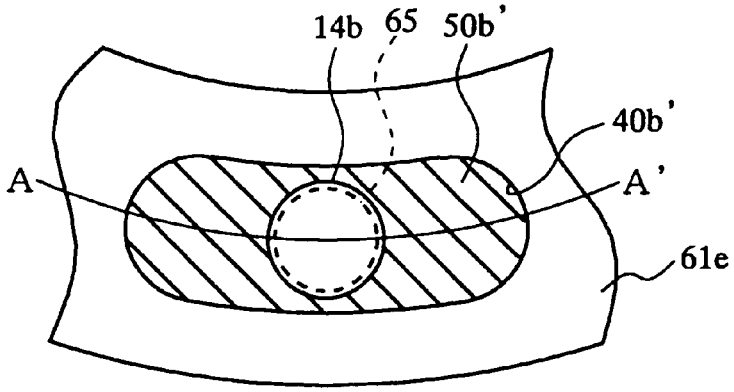
FIG. 9A is a view for explaining a flange in accordance with another example of falling preventive structure.
FIG. 9B is a sectional view taken along the line A-A' of FIG. 9A.
Figure 9:
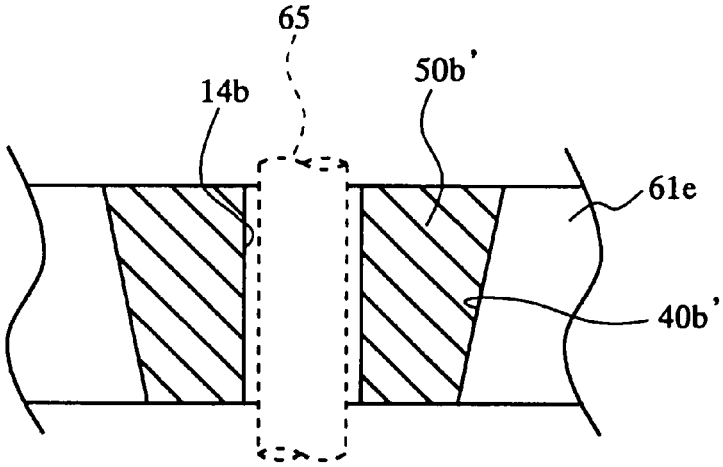
Figure 10:
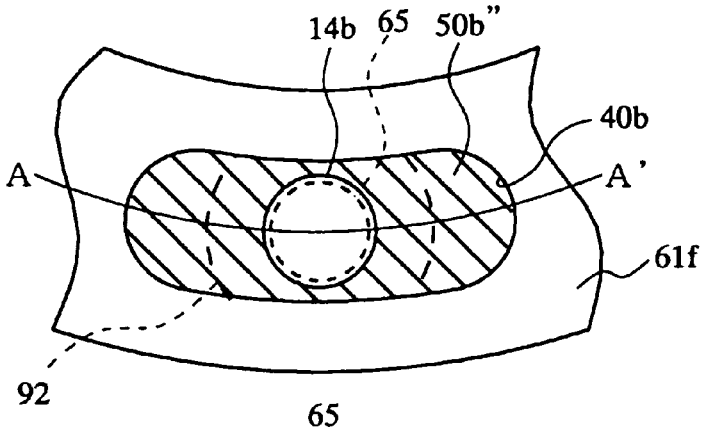
FIG. 10A is a view for explaining a flange in accordance with still another example of falling preventive structure.
FIG. 10B is a sectional view taken along the line A-A' of FIG. 10A.
Figure 10:
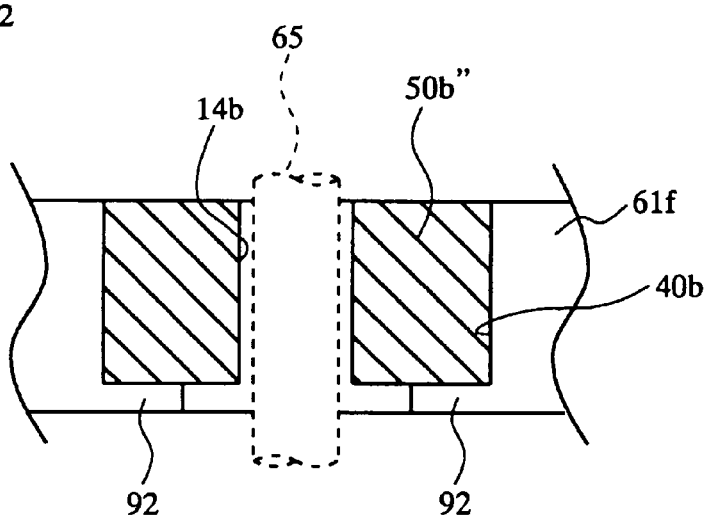

As shown in FIG. 8, the falling preventive structure for the shock absorbing member 50*b* is configured by using a washer 91.

The washer 91 consists of a ring-shaped plate member through which the bolt 65 penetrates in the central portion thereof, and is configured so that the outside diameter (the diameter on the outside) thereof is larger than the length in the radial direction of the flange 61*b* in the insertion hole 40*b*.

The washer 91 configured as described above is held between the flange 61*b* and the nut 66 (refer to FIG. 1) in the state in which the bolt 65 is inserted, namely, is held by the flange 61*b* and the nut 66.

The washer 91 functions as a stopper for resting the shock absorbing member 50*b* in the insertion hole 40*b*.

By providing such a falling preventive structure, the falling of the shock absorbing member 50*b* and the positional shift in the axial direction of the shock absorbing member 50*b* in the insertion hole 40*b* can be prevented.

Thereby, in the case where the molecular pump 1 is rotated by a great torque in the rotation direction of the rotor portion 24 generated in the molecular pump 1, for example, by the fracture of the rotor portion 24, the shock absorbing member 50*b* is subjected to plastic deformation properly (surely), by which a shock produced in the molecular pump 1 can be eased.

When the molecular pump 1 is fixed to the vacuum vessel 205, by pressingly inserting the bolt 65 from the flange 61 side of the molecular pump 1, the assembling work can be performed in the state in which the washer has been attached (assembled) to the bolt 65 in advance.

The bolt hole 14*b* need not be filled with the shock absorbing member 50*b*.

In this example, as the washer 91, a commercially available washer can be used, so that the product cost can be restrained.

FIG. 9A is a view for explaining a flange 61*e* in accordance with another example of falling preventive structure. FIG. 9B is a sectional view taken along the line A-A' of FIG. 9A.

For the flange 61*e*, the falling preventive structure is configured by inserting a shock absorbing member 50*b*' in an insertion hole 40*b*' the inside surface of which has been machined into a taper shape.

Specifically, the opposed surfaces of the inside surface (inner wall surface) of the insertion hole 40*b*' are machined into a taper shape tilting symmetrically.

The insertion hole 40*b*' is formed so that the area of an opening portion on the flange 62 side of the vacuum vessel 205 shown in FIG. 1 is larger than the area of an opening portion on the opposite side. That is to say, the insertion hole 40*b*' is formed so that the area decreases from the opening portion on the flange 62 side of the vacuum vessel 205 toward the opening portion on the opposite side (the nut 66 side).

The shock absorbing member 50*b*' the outside surface (outer wall surface) of which has been machined into a taper shape is inserted in the insertion hole 40*b*' so as to fit in the insertion hole 40*b*', namely, so as to correspond to the inside surface (inner wall surface) of the insertion hole 40*b*'. The shock absorbing member 50*b*' is inserted from the opening portion on the flange 62 side of the vacuum vessel 205, namely, from the upside in FIG. 9B.

By machining the inside surface (inner wall surface) of the insertion hole 40*b*' into a taper (inclination) shape in this manner, the falling preventive structure for the shock absorbing member 50*b*' can be configured easily.

By providing such a falling preventive structure, the falling of the shock absorbing member 50*b*' and the positional shift in the axial direction of the shock absorbing member 50*b*' in the insertion hole 40*b*' can be prevented.

Also, in the case where the molecular pump 1 is provided on the lower side of the vacuum vessel 205 as shown in FIG. 1, the opening portion on the flange 62 side of the vacuum vessel 205 of the insertion hole 40*b*', namely, the insertion port for the shock absorbing member 50*b*' is located on the upper side of the flange 61*e*.

Therefore, when the shock absorbing member 50*b*' is inserted into the insertion hole 40*b*', the shock absorbing member 50*b*' can be fixed temporarily. Therefore, the work efficiency at the assembling time can be improved.

In the above-described embodiment, the falling preventive structure consisting of the taper-shaped insertion hole 40*b*' in which the opposed surfaces of the inside surface tilt symmetrically has been explained. However, the falling preventive structure can be provided by tilting at least a part of the inside surface of the insertion hole 40*b*'.

The bolt hole 14*b* need not be filled with the shock absorbing member 50*b*'.

FIG. 10A is a view for explaining a flange 61*f* in accordance with still another example of falling preventive structure. FIG. 10B is a sectional view taken along the line A-A' of FIG. 10A.

For the flange 61*f*, the falling preventive structure for a shock absorbing member 50*b*" is configured by providing a projecting portion 92 projecting from the inside surface (inner wall surface) of the insertion hole 40*b* to the inside.

Specifically, on the inside surface (inner wall surface) of the insertion hole 40*b*, the flange-shaped projecting portion 92 projecting from the end portion on the opposite side to the flange 62 of the vacuum vessel 205 shown in FIG. 1, namely, on the nut 66 side to the inside is provided in both end portions (portions near the ends) in the lengthwise direction of the insertion hole 40*b*.

Like the above-described washer 91, the projecting portion 92 functions as a stopper for resting the shock absorbing member 50*b*" in the insertion hole 40*b*.

The shock absorbing member 50*b*" is formed so as to be thinner than the shock absorbing member 50*b*' by the thickness of the projecting portion 92.

By providing such a falling preventive structure, the falling of the shock absorbing member 50*b*" and the positional shift in the axial direction of the shock absorbing member 50*b*" in the insertion hole 40*b* can be prevented.

Also, in the case where the molecular pump 1 is provided on the lower side of the vacuum vessel 205 as shown in FIG. 1, the opening portion on the projecting portion 92 side of the insertion hole 40*b* is located on the lower side of the flange 61*f*.

Therefore, when the shock absorbing member 50*b*" is inserted into the insertion hole 40*b*, the shock absorbing member 50*b*" can be fixed temporarily. Therefore, the work efficiency during assembly can be improved.

In place of the provision of the above-described falling preventive structures, an adhesive may be applied to prevent the shock absorbing member 50 (50*a* to 50*d*) from falling.

The bolt hole 14*b* need not be filled with the shock absorbing member 50*b*".

In the above-described embodiment, the case has been shown in which the shock absorbing member 50 (including the shock absorbing members 50*a* to 50*d* of modifications) has a thickness equal to the thickness of the flange 61 (including the flanges 61*a* to 61*f* of modifications).

However, the thickness of the shock absorbing member 50 (50*a* to 50*d*) is not limited to this thickness.

Figure 11:
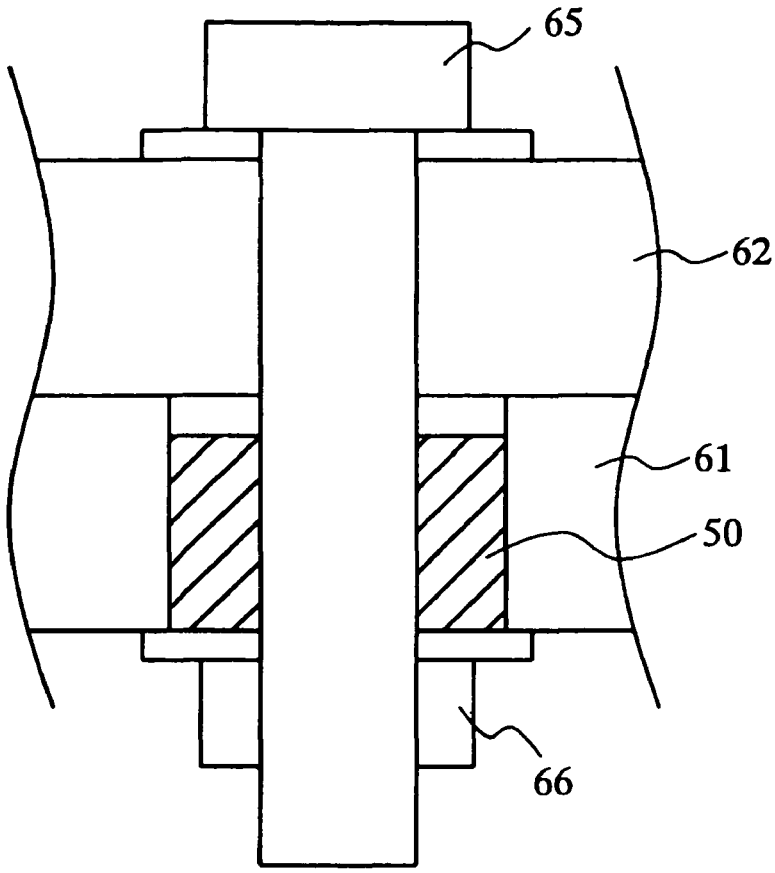
FIG. 11 is a view for explaining a shock absorbing structure using a shock absorbing member having a thickness smaller than that of a flange.

FIG. 11 is a view for explaining a shock absorbing structure using the shock absorbing member 50 having a thickness smaller than that of the flange 61.

For example, as shown in FIG. 11, the shock absorbing structure can be configured by using the shock absorbing member 50 having a thickness smaller than that of the flange 61.

By using the shock absorbing member 50 having a thickness smaller than that of the flange 61, the molecular pump 1 can be fixed properly to the vacuum vessel 205 by joining (adhering) the flange 61 to the flange 62 without the influence of the shock absorbing member 50 being exerted.

That is to say, since the position of the molecular pump 1 is set based on the flanges 61 and 62 that are formed with high accuracy, pipes can be connected to the exhaust port 19 and a cooling water port with high accuracy (exactly) without a decrease in positioning accuracy of the molecular pump 1.

Herein, having a thickness smaller than that of the flange 61 includes the thickness that is set so as to be small by the tolerance on the working drawing.

Figure 12:
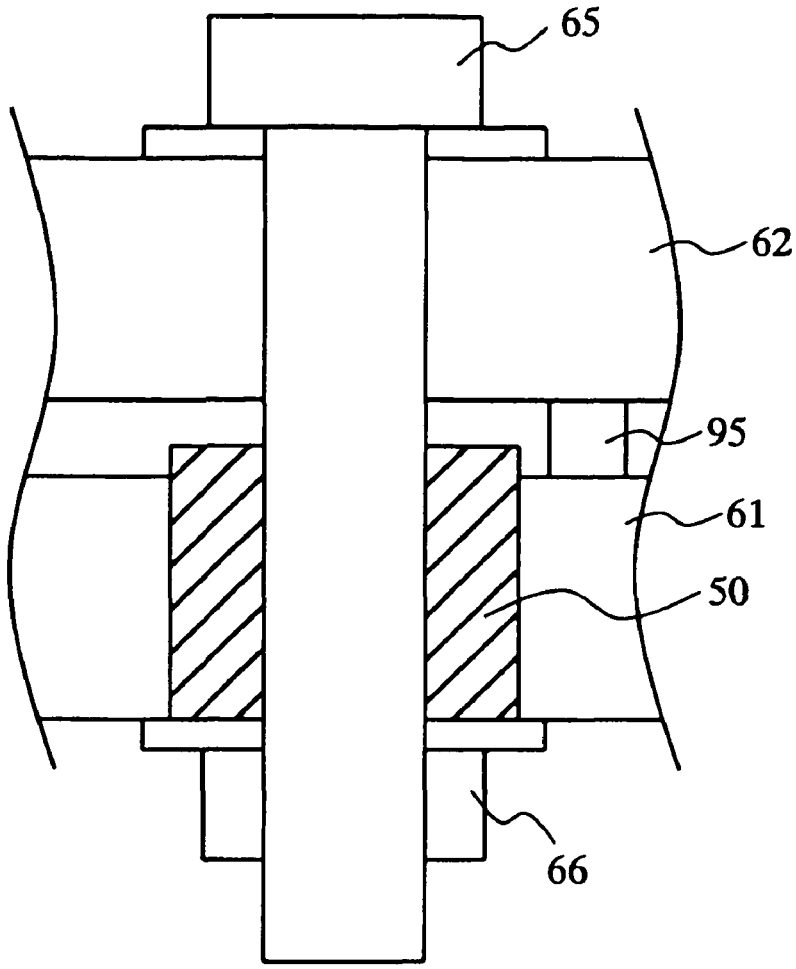
FIG. 12 is a view for explaining a shock absorbing structure using a shock absorbing member having a thickness larger than that of a flange.

FIG. 12 is a view for explaining a shock absorbing structure using the shock absorbing member 50 having a thickness larger than that of the flange 61.

For example, as shown in FIG. 12, the shock absorbing structure can be configured by using the shock absorbing member 50 having a thickness larger than that of the flange 61.

However, in the case where the shock absorbing member 50 having a thickness larger than that of the flange 61 is used, as shown in FIG. 12, a spacer 95 functioning as a positioning member is used additionally to overcome a decrease in joint accuracy between the flange 61 and the flange 62, which is caused by variations in the shape of the shock absorbing member 50, namely, by variations in the height of a portion projecting from the flange 61.

The spacer 95 is a ring-shaped member provided near the outer peripheral end of the flange 61. Also, the spacer 95 is a metallic member formed with high accuracy so that the thickness thereof is uniform throughout the entire region.

The spacer 95 is formed, considering the variations in the shape of the shock absorbing member 50, so that the thickness thereof is larger than the height of the portion projecting from the flange 61.

By joining the flange 61 to the flange 62 via such a spacer 95, the positioning at the time when the molecular pump 1 is fixed to the vacuum vessel 205 can be performed properly without an influence of variations in the shape of the shock absorbing member 50 being exerted. Thereby, pipes can be connected to the exhaust port 19 and a cooling water port with high accuracy (exactly).

In this embodiment, the ring-shaped spacer 95 is used. However, the shape of the spacer 95 is not limited to this shape. For example, the spacer 95 may be formed by a plurality of members (pieces) capable of being disposed partially on the flange 61.

Also, the spacer 95 may be formed integrally with the flange 61 in advance.

As described above, according to this embodiment, the method for attaching the molecular pump 1 (flange 61) to the vacuum vessel (flange 62) is changed according to the shape of the shock absorbing member 50, by which the positioning of the molecular pump 1 can be performed properly (exactly).

Figure 13:
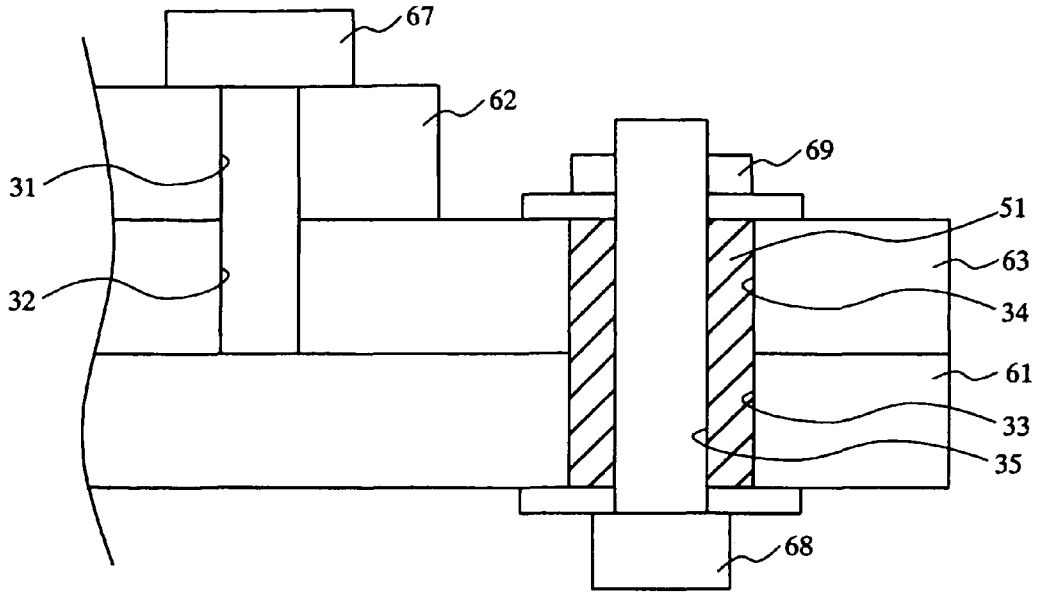
FIG. 13 is a view showing another mode in which a molecular pump in accordance with an embodiment of the present invention is attached to a vacuum vessel.

FIG. 13 is a view showing another mode in which the molecular pump 1 in accordance with this embodiment is attached to the vacuum vessel 205.

The flange 61 of the molecular pump 1 may be joined to the flange 62 of the vacuum vessel 205 via an intermediate flange 63 having the same shape as that of the flange 61 as shown in FIG. 13.

Specifically, the flange 62 is provided with a bolt holes 31 through which bolts 67 are inserted.

The intermediate flange 63 is provided with bolt holes 32 each having threads (thread groove) for tightening and fixing the bolt 67 on the inside surface (inner wall surface) thereof.

The bolt holes 31 and the bolt holes 32 are formed at the same position on a concentric circle.

By inserting the bolts 67 through the bolt holes 31 and by threadedly tightening the bolts 67 in the bolt holes 32, the flange 62 of the vacuum vessel 205 and the intermediate flange 63 are fixed to each other.

Also, in the flange 61 of the molecular pump 1 and the intermediate flange 63, a plurality of insertion holes 33 and 34, respectively, each having the same shape for inserting a shock absorbing member 51 are formed at the same position on a concentric circle.

In the insertion holes 33 and 34, the shock absorbing member 51 is inserted continuously.

Like the above-described shock absorbing member 50 and 50*a* to 50*e*, the shock absorbing member 51 is provided with a bolt hole 35 through which a bolt 68 is inserted. Also, like the flange 61*a* shown in FIG. 4, the bolt hole 35 may be provided on the outside of the insertion holes 33 and 34 for the shock absorbing member 51.

In the state in which the flange 61 of the molecular pump 1 and the intermediate flange 63 are lapped on each other, the shock absorbing member 51 is inserted in the insertion holes 33 and 34. Further, by inserting the bolts 68 through the bolt holes 35 and by threadedly tightening nuts 69 on the bolts 68, the flange 61 of the molecular pump 1 and the intermediate flange 63 are fixed to each other.

The insertion holes 33 and 34 are configured so as to have the same shape as that of the insertion hole 40 (40*a* to 40*d*) explained in the embodiment including the modifications.

The shock absorbing member 51 is also configured so as to have the same shape as that of the shock absorbing member 50 (50*a* to 50*d*) explained in the embodiment including the modifications.

However, the thickness of the shock absorbing member 51 is formed so as to correspond to the sum of the thicknesses of the flange 61 and the intermediate flange 63. That is to say, the shock absorbing member 51 is formed integrally throughout the insertion holes 33 and 34 without a joint at the boundary between the intermediate flange 63 and the flange 61.

Since the flange 62 of the vacuum vessel 205 and the flange 61 of the molecular pump 1 are joined (fixed) via the intermediate flange 63, in the case where some trouble occurs during the operation of the molecular pump 1, and thereby, for example, the rotor portion 24 is fractured, the shock absorbing member 51 hits the bolt 68 and is subjected to plastic deformation. Therefore, the rotation energy of the molecular pump 1 can be absorbed by the flange 61 of the molecular pump 1 and the intermediate flange 63, so that the influence on (damage to) the vacuum vessel 205 due to a shock produced in the molecular pump 1 can be reduced.

In this example, due to the use of the intermediate flange 63, the bolt 68 does not directly hit the boundary surface between the flange 61 and the intermediate flange 63, so that the burden on the bolt 68 can be alleviated.

Figure 14:
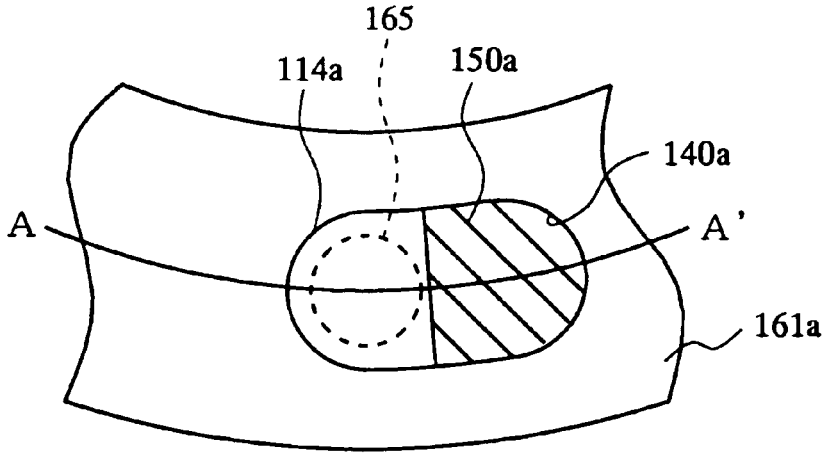
FIG. 14A is a view for explaining a flange in accordance with another example of a shock absorbing structure.
FIG. 14B is a sectional view taken along the line A-A' of FIG. 14A.
Figure 14:
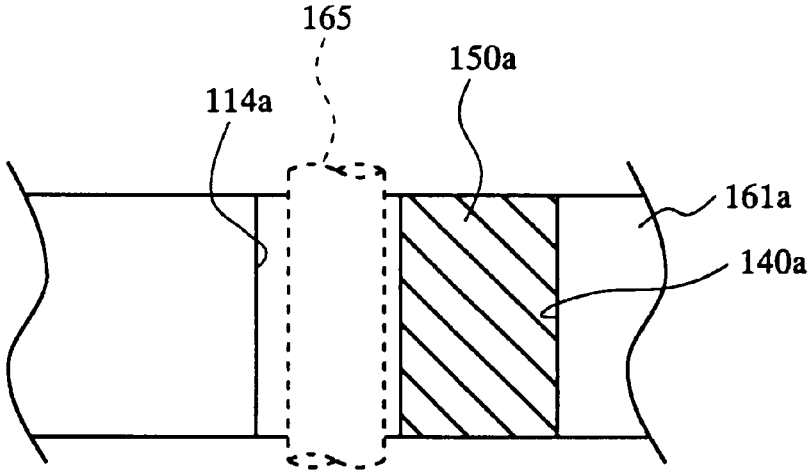

FIG. 14A is a view for explaining a flange 161*a* in accordance with another example of the shock absorbing structure. FIG. 14B is a sectional view taken along the line A-A' of FIG. 14A.

The flange 161*a* is provided with a bolt penetrating portion 114*a* through which a bolt penetrates and an insertion portion 140*a* in which a shock absorbing member is inserted. As is apparent from these figures, the bolt penetrating portion 114*a* and insertion portion 140*a* are arranged in the same void formed in the flange 161*a*.

Specifically, in the flange 161*a*, a plurality of substantially semicircular insertion holes 140*a* are provided at predetermined intervals in the direction reverse to the rotation direction of the rotor portion 24, and a shock absorbing member 150*a* formed by a separate member is inserted in each of the insertion holes 140*a*. In the insertion hole 140*a*, a bolt hole 114*a* is provided. As shown in these figures, the insertion hole 140*a* has a shape extending on the opposite side to the rotation direction of the rotor with respect to the bolt hole 114*a*.

In the case where the molecular pump 1 is rotated by a great torque in the rotation direction of the rotor portion 24 generated in the molecular pump 1, for example, by the fracture of the rotor portion 24, the shock absorbing member 150*a* hits a bolt 165 and is subjected to plastic deformation. Thereby, the rotation energy of the molecular pump 1 is absorbed, and thus a shock produced in the molecular pump 1 is eased.

Figure 4:
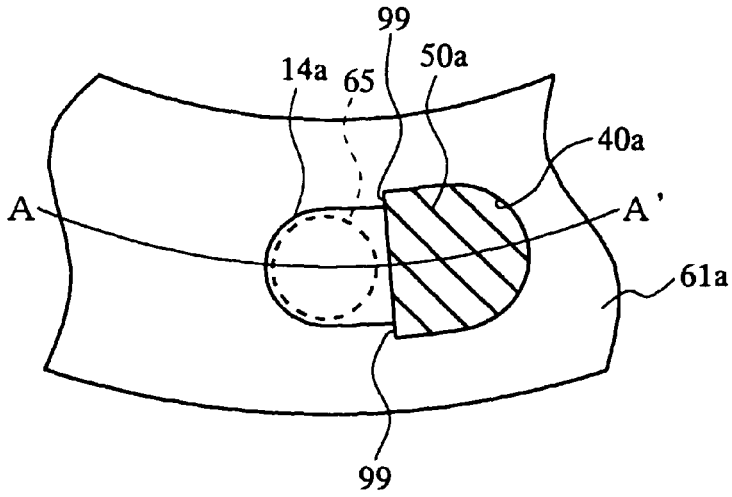
FIG. 4A is a view for explaining a flange in accordance with another example of shock absorbing structure.
FIG. 4B is a sectional view taken along the line A-A' of FIG. 4A.
Figure 4:
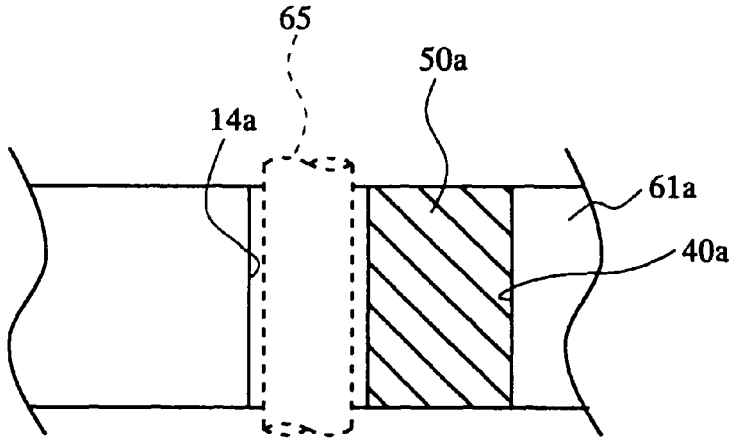

In this example, unlike the example shown in FIG. 4, no step portion is provided on the boundary surface between the bolt hole 114*a* and the insertion hole 140*a*.

The invention claimed is:

1. A molecular pump comprising:

a cylindrical casing;

a stator portion formed in the casing;

a shaft disposed in the stator portion;

a bearing pivotally supporting the shaft with respect to the stator portion;

a rotor which is attached to the shaft and rotates integrally with the shaft;

a motor for rotationally driving the shaft;

a shock absorbing member; and a flange portion provided at an end portion of the casing, the flange portion having a bolt hole through which a bolt for fixing the casing and a fixed member to each other penetrates and an insertion hole which is provided adjacent to the bolt hole and in which the shock absorbing member is inserted so that at least one end side, furthest in an axial direction of the bolt, of the shock absorbing member is axially spaced apart from a head of the bolt or a member that is to be fixed by the bolt.

2. The molecular pump according to claim 1, wherein the bolt hole and the insertion hole are combined into a single elongated opening.

3. The molecular pump according to claim 2, wherein any part of the flange portion does not exist in the single elongated opening.

4. The molecular pump according to claim 1, wherein the shock absorbing member extends into the bolt hole.

5. The molecular pump according to claim 1, wherein the bolt is surrounded by the shock absorbing member.

6. The molecular pump according to claim 1, wherein a thin-wall portion is formed in the shock absorbing member by creating a cavity.

7. The molecular pump according to claim 6, wherein the cavity is a through-hole formed by penetrating the shock absorbing member.

8. The molecular pump according to claim 1, wherein the insertion hole is provided in a direction opposite to the rotation direction of the rotor with respect to the bolt.

9. The molecular pump according to claim 1, wherein the insertion hole has a shape extending lengthwise in a circumferential direction.

10. The molecular pump according to claim 1, wherein the shock absorbing member has a thickness smaller than that of the flange portion.

11. The molecular pump according to claim 1, wherein the shock absorbing member has a thickness larger than that of the flange portion, and a spacer member is provided between the flange portion and the fixed member.

12. The molecular pump according to claim 1, wherein a falling preventive structure for preventing falling of the shock absorbing member is provided.

13. The molecular pump according to claim 12, wherein the falling preventive structure is formed by a washer through which the bolt penetrates.

14. The molecular pump according to claim 12, wherein the falling preventive structure is formed by a projecting portion provided on the flange portion.

15. The molecular pump according to claim 12, wherein the falling preventive structure is formed by the insertion hole at least a part of the inside surface of which is inclined.

16. The molecular pump according to claim 1, wherein the shock absorbing member is formed of a gel material.

17. The molecular pump according to claim 1, wherein the molecular pump further comprises an intermediate flange provided between the flange portion and the fixed member, and the flange portion is fixed to the fixed member via the intermediate flange.

18. The molecular pump according to claim 1, wherein the bolt hole and the insertion hole are arranged in an identical void formed in the flange portion.

19. The molecular pump according to claim 18, wherein the void formed in the flange portion has a shape extending in a direction opposite to the rotation direction of the rotor with respect to the bolt hole.

20. A molecular pump comprising:

a cylindrical casing;

a stator portion formed in the casing;

a shaft disposed in the stator portion;

a bearing pivotally supporting the shaft with respect to the stator portion;

a rotor which is attached to the shaft and rotates integrally with the shaft;

a motor for rotationally driving the shaft;

a shock absorbing member; and a flange portion provided at an end portion of the casing, the flange portion having a bolt penetrating portion through which a bolt for fixing the casing and a fixed member to each other penetrates and an insertion portion in which the shock absorbing member is inserted so that at least one end side, furthest in an axial direction of the bolt, of the shock absorbing member is axially spaced apart from a head of the bolt or a member that is to be fixed by the bolt.

21. The molecular pump according to claim 20, wherein the bolt penetrating portion and the insertion portion are arranged in an identical void formed in the flange portion.

22. The molecular pump according to claim 21, wherein the void formed in the flange portion has a shape extending in a direction opposite to the rotation direction of the rotor with respect to the bolt penetrating portion.

23. The molecular pump according to claim 20, wherein the shock absorbing member has a thin-wall portion.

24. The molecular pump according to claim 20, wherein the insertion portion is provided in a direction opposite to the rotation direction of the rotor with respect to the bolt.

25. The molecular pump according to claim 20, wherein the insertion portion has a shape extending lengthwise in a circumferential direction.

26. The molecular pump according to claim 20, wherein the shock absorbing member has a thickness smaller than that of the flange portion.

27. The molecular pump according to claim 20, wherein the shock absorbing member has a thickness larger than that of the portion, and a spacer member is provided between the flange portion and the fixed member.

28. The molecular pump according to claim 20, wherein a falling preventive structure for preventing falling of the shock absorbing member is provided.

29. The molecular pump according to claim 28, wherein the falling preventive structure is formed by a washer through which the bolt penetrates.

30. The molecular pump according to claim 28, wherein the falling preventive structure is formed by a projecting portion provided on the flange portion.

31. The molecular pump according to claim 28, wherein the falling preventive structure is formed by the insertion portion at least a part of the inside surface of which is inclined.

32. The molecular pump according to claim 20, wherein the shock absorbing member is formed of a gel material.

33. The molecular pump according to claim 20, wherein the molecular pump further comprises an intermediate flange provided between the flange portion and the fixed member, and the flange portion is fixed to the fixed member via the intermediate flange.

34. A flange for connecting an end portion of a casing for a molecular pump to a fixed member, comprising:

a shock absorbing member;

a bolt hole through which a bolt for fixing the flange to the fixed member or the casing penetrates; and an insertion hole which is provided adjacent to the bolt hole and in which the shock absorbing member is inserted so that at least one end side, furthest in an axial direction of the bolt, of the shock absorbing member is axially spaced apart from a head of the bolt or a member that is to be fixed by the bolt.

35. The flange according to claim 34, wherein the bolt hole and the insertion hole are combined into a single elongated opening.

36. The flange according to claim 35, wherein any part of the flange portion does not exist in the single elongated opening.

37. The flange according to claim 35, wherein the shock absorbing member extends into the bolt hole.

38. The flange according to claim 35, wherein the bolt is surrounded by the shock absorbing member.

39. The flange according to claim 35, wherein a thin-wall portion is formed in the shock absorbing member by creating a cavity.

40. The flange according to claim 39, wherein the cavity is a through-hole formed by penetrating the shock absorbing member.

41. A flange for connecting an end portion of a casing for a molecular pump to a fixed member, comprising:

a shock absorbing member;

a bolt penetrating portion through which a bolt for fixing the flange to the fixed member or the casing penetrates; and an insertion portion in which the shock absorbing member is inserted so that at least one end side, furthest in an axial direction of the bolt, of the shock absorbing member is axially spaced apart from a head of the bolt or a member that is to be fixed by the bolt.

42. The flange according to claim 41, wherein the bolt penetrating portion and the insertion portion are arranged in an identical void formed in the flange.

* * * * *

UNITED STATES PATENT AND TRADEMARK OFFICE

CERTIFICATE OF CORRECTION

PATENT NO. : 8,403,652 B2
APPLICATION NO. : 12/225041
DATED : March 26, 2013
INVENTOR(S) : Maejima et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 917 days.

Signed and Sealed this
First Day of September, 2015

Michelle K. Lee

Michelle K. Lee
*Director of the United States Patent and Trademark Office*